United States Patent [19]

Lendi

[11] 3,937,139

[45] Feb. 10, 1976

[54] COMPRESSING REFUSE

[75] Inventor: Ulrich Lendi, Stafa, Switzerland

[73] Assignee: Mageba S.A., Bulach, Switzerland

[22] Filed: Sept. 3, 1974

[21] Appl. No.: 501,924

[30] Foreign Application Priority Data

Sept. 5, 1973 Germany ..... 2344698

[52] U.S. Cl. ..... 100/215; 100/218; 100/246

[51] Int. Cl.[2] ..... B30B 15/30; B30B 15/32

[58] Field of Search..... 100/215, 218, 98 R, 229 A, 100/229 R, 240, 246, 248, 249, 190

[56] References Cited

UNITED STATES PATENTS

| | | | |
|---|---|---|---|
| 2,575,672 | 11/1951 | Miller | 100/218 X |
| 2,780,987 | 2/1957 | Wall | 100/190 X |
| 3,195,447 | 7/1965 | Taylor | 100/218 X |
| 3,355,044 | 11/1967 | Nelson | 100/218 X |
| 3,454,174 | 7/1969 | Nelson | 100/218 X |
| 3,469,530 | 9/1969 | Walker et al. | 100/215 |

*Primary Examiner*—Billy J. Wilhite

*Attorney, Agent, or Firm*—William Anthony Drucker

[57] ABSTRACT

A device, for compressing refuse and carrying away the compressed refuse in containers, of the kind including (i) a bulk container having on its upper side a charging opening, (ii) a pressure plate for compressing refuse in that part of the bulk container forming a compressing space, (iii) a lifting system for raising compressed refuse in front of an ejection opening, and (iv) a discharging device located above the compressing space, characterised in that said lifting device is a cage open on the charging and discharging sides.

5 Claims, 7 Drawing Figures

COMPRESSING REFUSE

Figure 1:
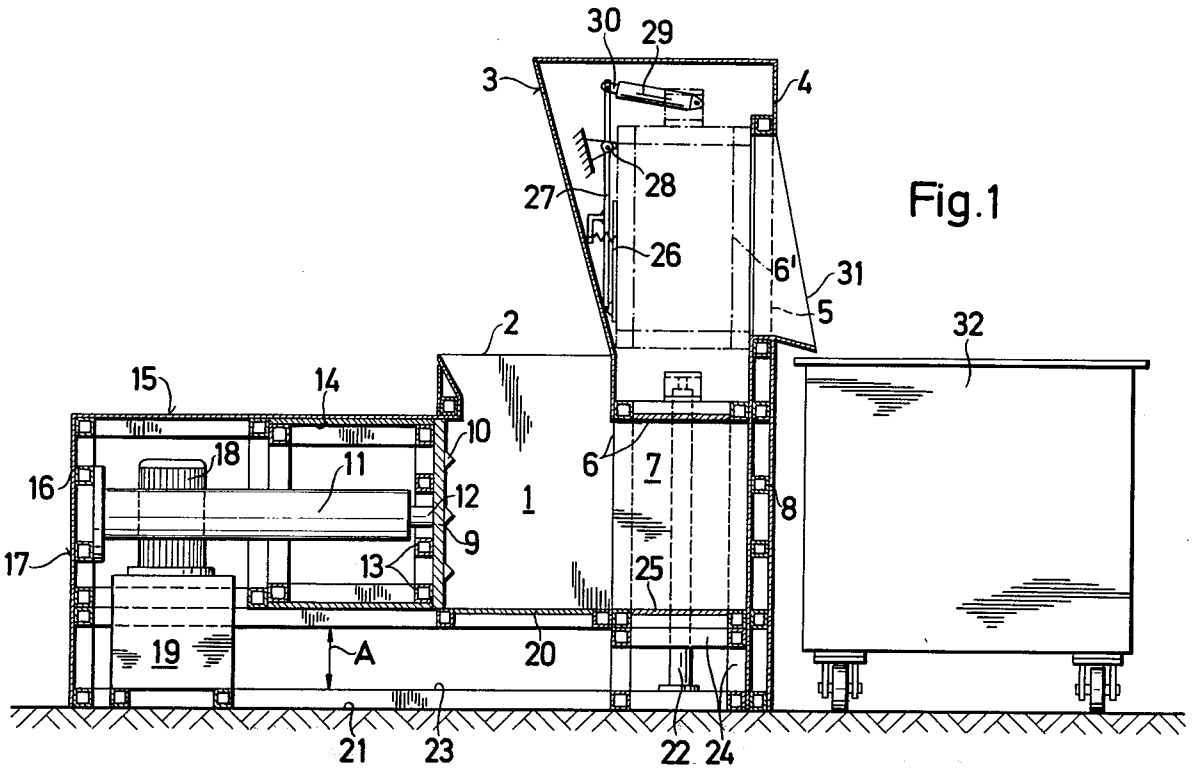

The invention concerns a device for compressing refuse and carrying away the compressed refuse in containers, with a bulk container having, on its upper side, and if necessary at a height suitable for manual feeding, a charging opening, and with a lifting system for raising the refuse, which is compressed by a pressure plate in the section of the bulk container forming the compressing space, in front of an ejection opening and a discharge device located above the compressing space.

In one known apparatus of the type mentioned above the refuse is fed by hand into a lower charging opening, is then compressed in the bulk container above a lifting plate by means of which, after being compressed, it is raised in front of an ejection opening and thrown out by means of a discharge device.

In the known equipment, compression is effected by swivelling a pressure plate adjoining the ejection opening which, for the purpose of compressing the refuse, can be swivelled from an oblique to a vertical position. It is not possible to feed in refuse during the swivelling movement or when the pressure plate is in a vertical position. During the swivelling movement of the pressure plate, there is a danger that refuse which has already been fed in will be forced out again.

A particular disadvantage of the known equipment is that the degree of compression which can be achieved is very small, as it is not possible to tilt the pressure plate in the interior of the compressing space of the bulk container containing the compressed pile of refuse. The degree of compression is further reduced because the compressing space of the bulk container is open at the top. As a result, the refuse can escape upwards during the compressing movement of the pressure plate.

A further disadvantage of the known equipment is that a large frictional force has to be overcome during the lifting movement of the compressed pile of refuse.

In contrast, the invention sets out to make it possible, with a device for hand feeding and an ejection opening located on top, to use a high ramming pressure to achieve a large compression and unhindered ejection of the compressed refuse. According to the invention, this problem has a device of the type initially described is solved by fitting, as a lifting device, a cage which is open at the charging and ejection side.

The arrangement of the cage prevents the refuse from escaping to the side while being compressed by the pressure plate. As a result, and with a sensible layout of the design, any desired degree of compression of the pile of refuse can be achieved inside the cage, the ejection side of which, when in the lowered position, is bounded by a wall of the bulk container. This is especially so if, in accordance with the preferred form of construction of the invention, the pressure plate is translatorily fitted so that it can be moved to any desired depth into the interior of the cage. With suitably strong walls of the bulk container and with appropriate use of hydraulic cylinders to drive the pressure plate, the refuse can be compressed to about 5 to 20% of its loose bulk.

The solution proposed in the invention makes it possible to achieve spatially compact equipment of the type initially described, in which the compressed pile of refuse is raised into an upper position suitable for loading into containers and can be discharged there. Together with one wall of the bulk container, the cage forms a closed receptacle into the interior of which the refuse can be compressed. In a completely enclosed form, the cage permits odour-proof closure of the compression space containing the refuse. As the lateral ramming pressure is absorbed by the cage, the dimensions of the side walls of the bulk container can be correspondingly smaller.

Within the concept of the invention, the cross-section of the bulk containers and of the cage can also deviate from the rectangular.

A preferred form of construction of the invention provides for the direction of movement of the pressure plate to be horizontal or, in another variation, obliquely downwards, and the direction of movement of the cage upwards at right angles thereto. The raisable cage is a very important and novel feature of equipment of the type initially described. It permits the space-saving transport of the compressed refuse at a height suitable for discharge in the container.

A further proposal of the invention consists in having the floor of the bulk container above the level of the floor of the device. As a result of this feature, the lifting cylinders for raising the cage, which are braced on the ground, can be of shorter dimensions which, all in all, leads to a reduced height of the equipment.

Within the concept of the invention, any cross-section can be selected for the bulk container. Where the pressure plate is rectangular, it is desirable that the bulk container and the cage should each be of square shape, that is to say, of rectangular cross-section.

It is advantageous to design the floor supports of the cage at such a height that the inner surface of its wall nearest the ground is in the same plane as the rest of the floor of the bulk container.

Hydraulic cylinders are to be preferred as the driving mechanism for the pressure plate, the cage and the ejector plate. To reduce the designed height of the equipment, it can be of advantage to use a cable, passing once or several times over rollers, e.g., in the form of block and tackle, to drive the cage, the pull on the cable being in turn produced by means of hydraulic cylinders or an electromotor winding the cable on to a drum.

Various forms of construction are feasible for the drive of the ejection plate which, to discharge the compressed refuse from the raised cage, must be moved along the entire length of the interior of the cage. This can be simply achieved by means of a hinged rocking lever on the rear of the plate, to drive which a hydraulic cylinder can be fitted. Alternatively, however, the ejection plate can be operated by scissor linkage or a toggle lever, which can also with advantage be extended and retracted by hydraulic cylinders. The types of linkage mentioned have the advantage of taking up very little room at the rear of the ejection plate, are not restricted in terms of the forces to be applied and, because of the favourable nature of the stresses, are characterised by a long working life. The main consideration affecting the choice of these types of linkage, however, is the small amount of space required, seeing that the compact design of the equipment requires the charging opening to be located directly alongside the cage. A refuse chute connected to the charging opening therefore takes up part of the space at the rear of the ejection plate.

A particularly space-saving version of the device in accordance with the invention is characterised by having the charging opening directly alongside an attachment to the bulk container, in the interior of which the ejection plate and the operating mechanism are accommodated, and by locating the discharge opening in the side wall of the attachment opposite to the charging opening. The height of the attachment, the lift of the cage and the location of the discharge opening in the attachment are determined by the height of the container into which the compressed refuse is to be loaded. It is therefore desirable that the lower edge of the discharge opening be located level with or higher than the position of the upper edge of a standard container placed at the same height as the equipment.

Figure 2:
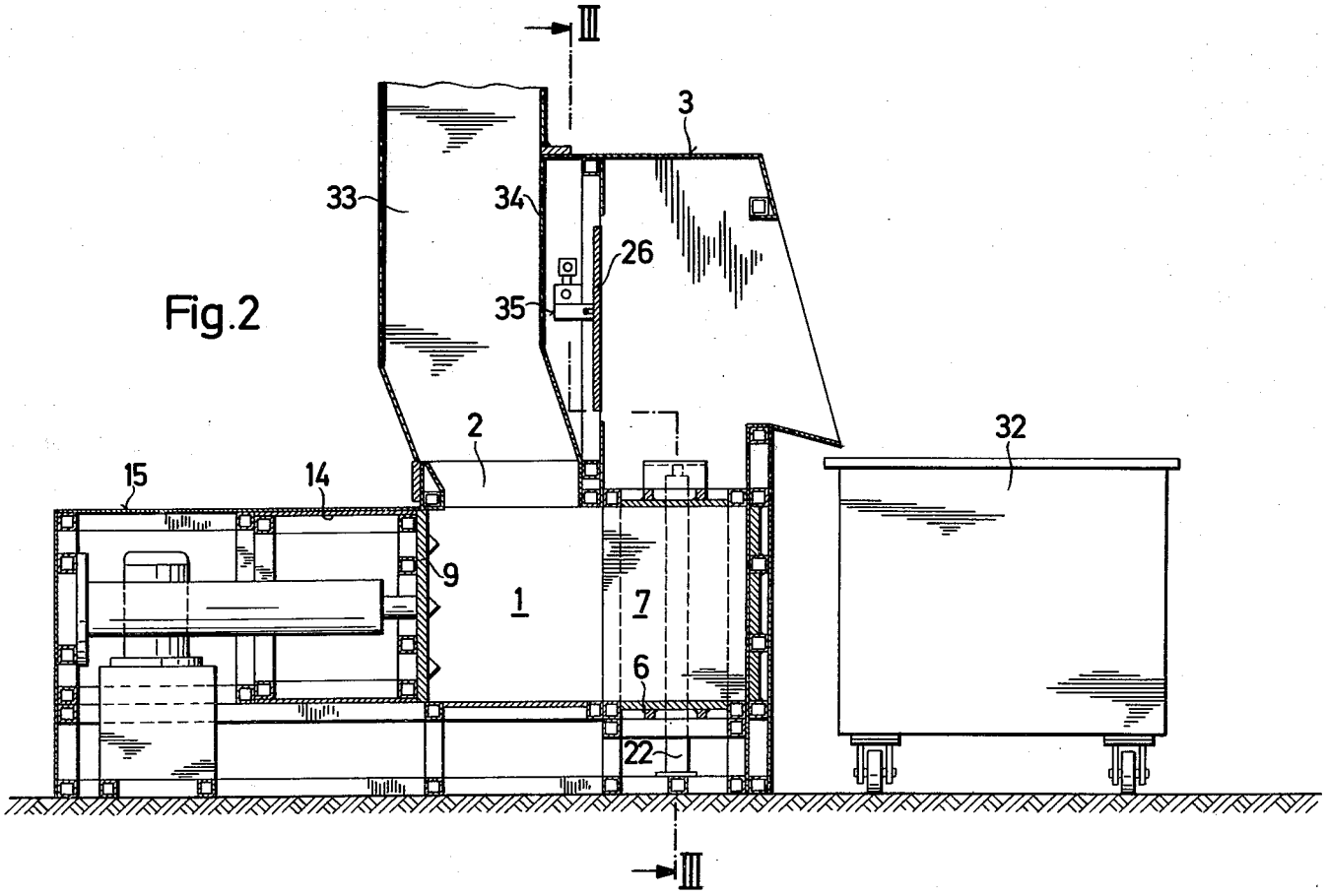
Figure 3:
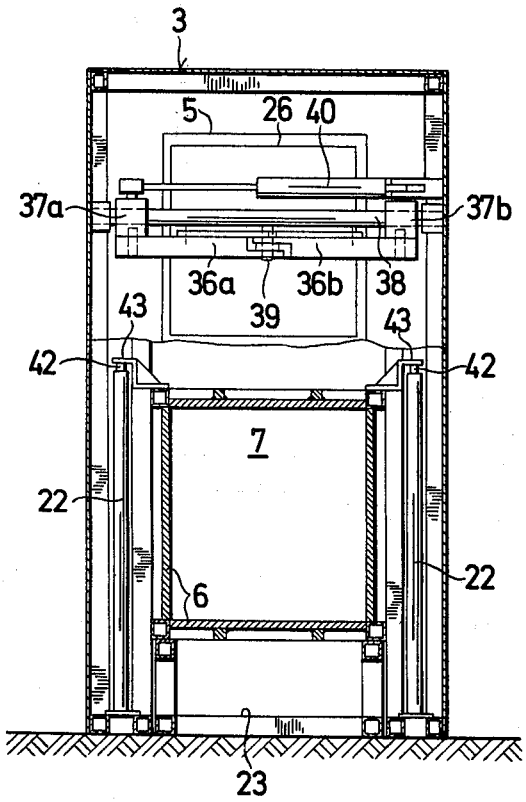
Figure 4:
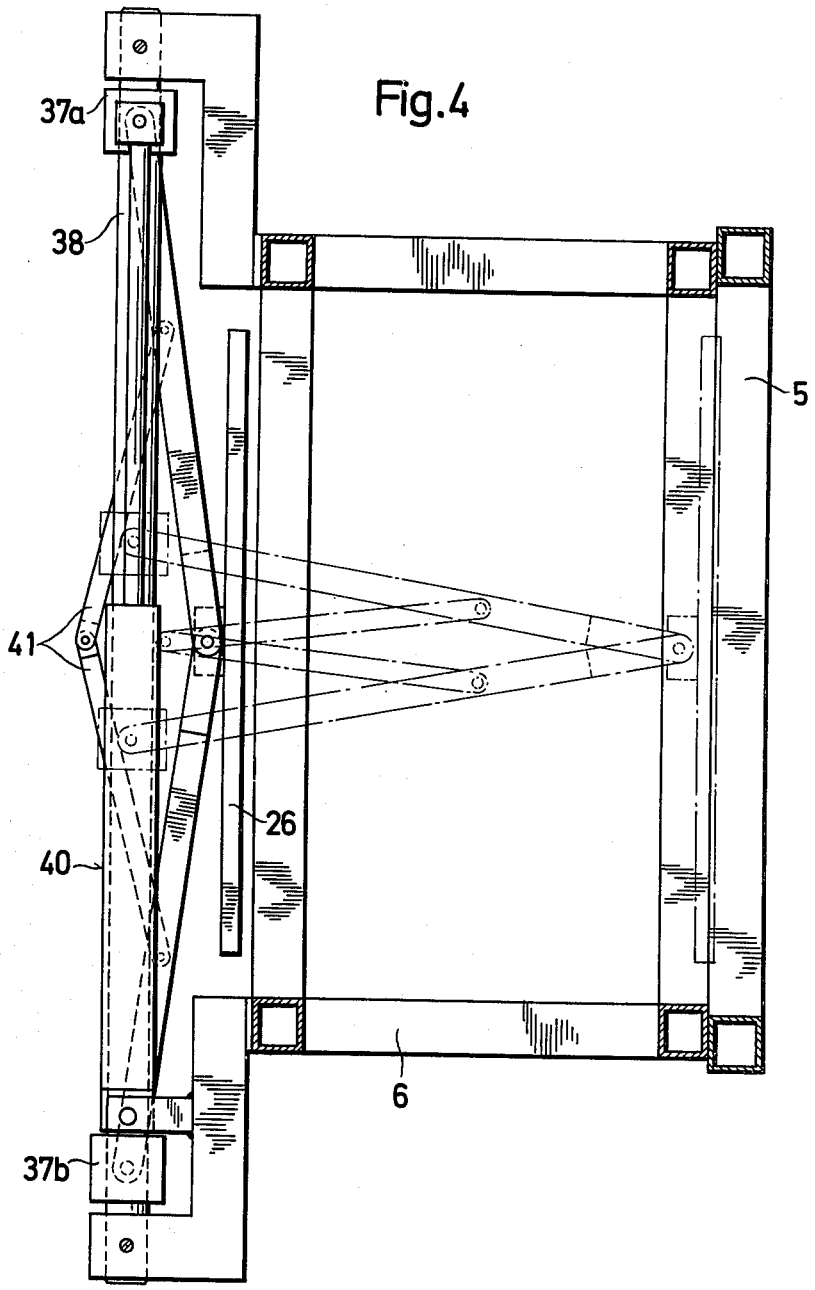
Figure 5:
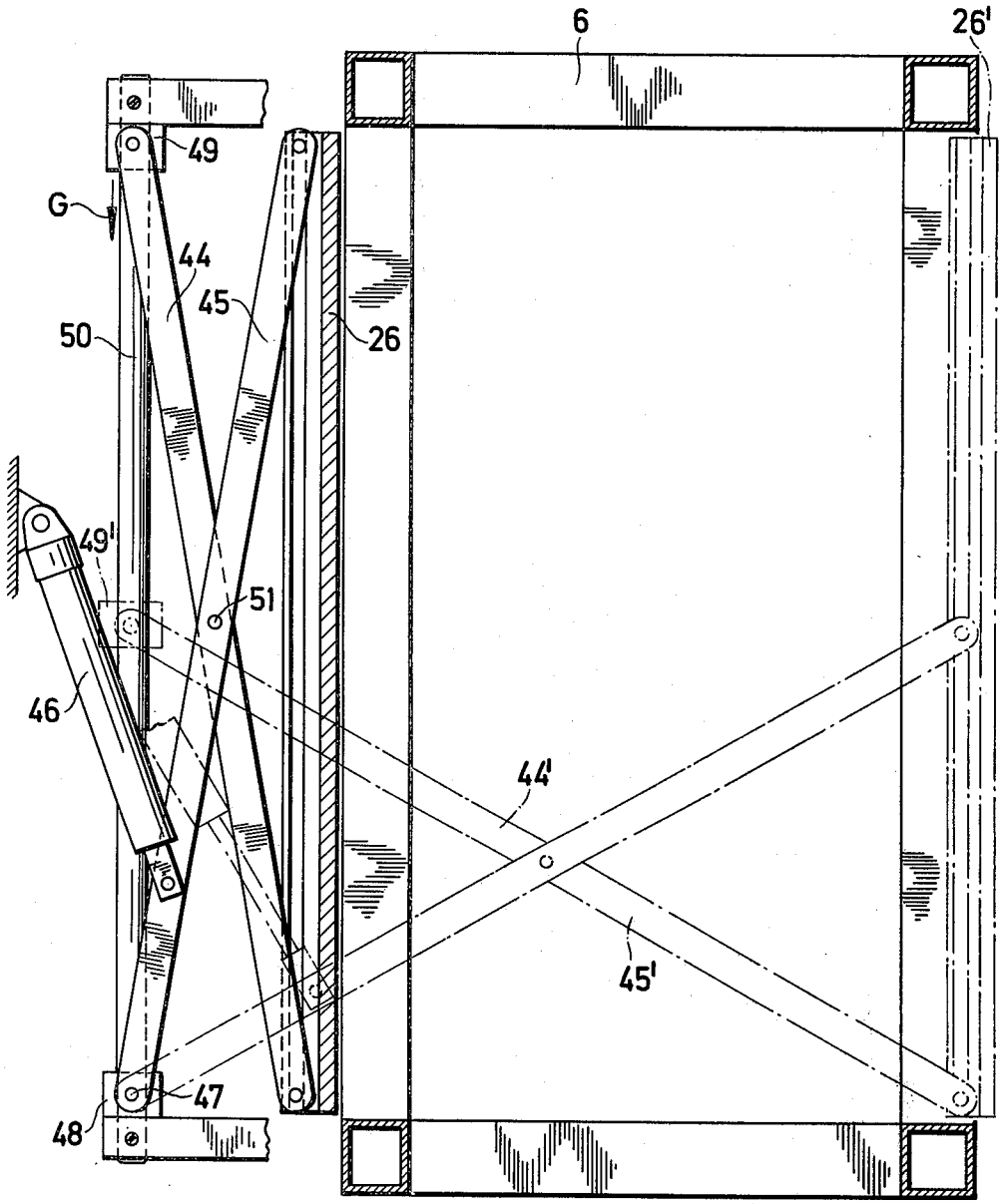
Figure 6:
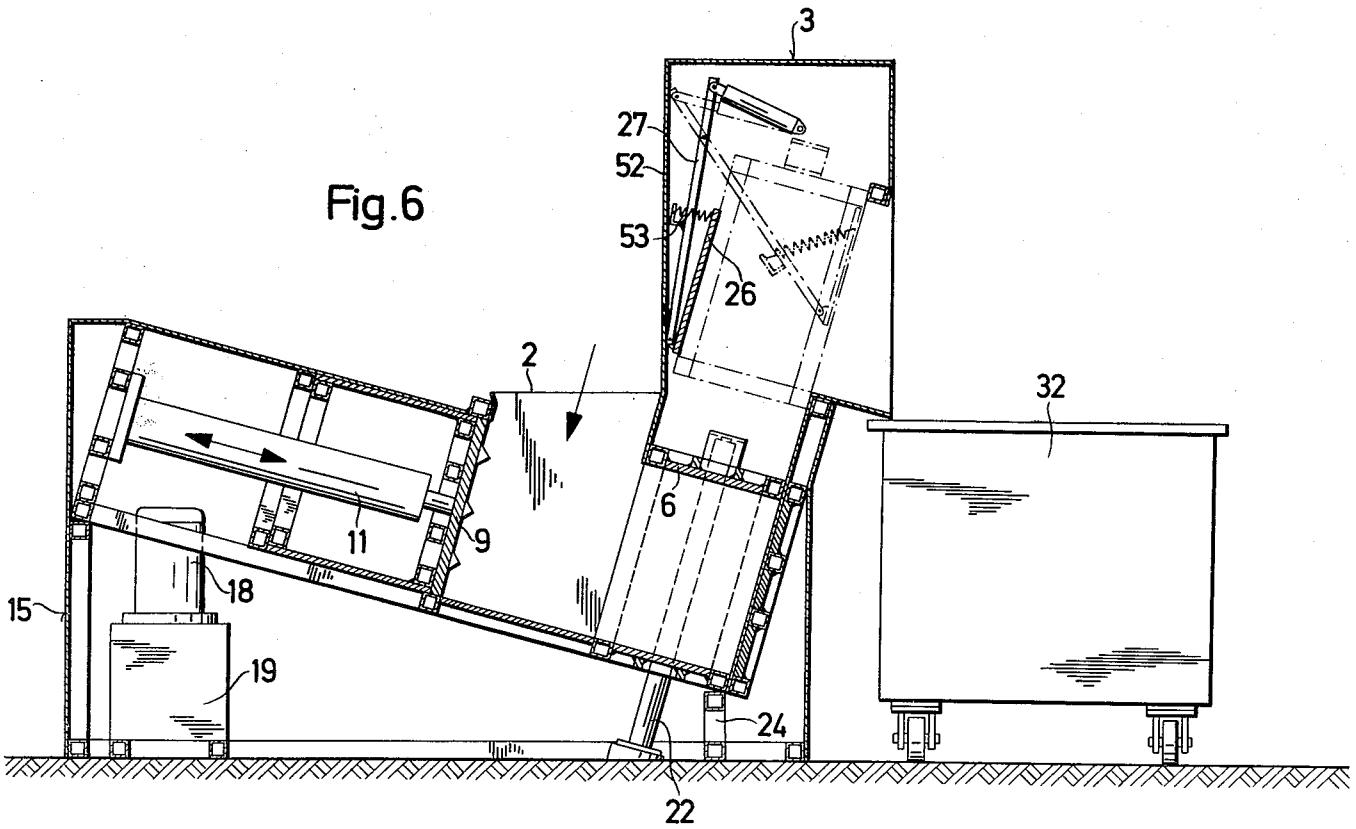
Figure 7:
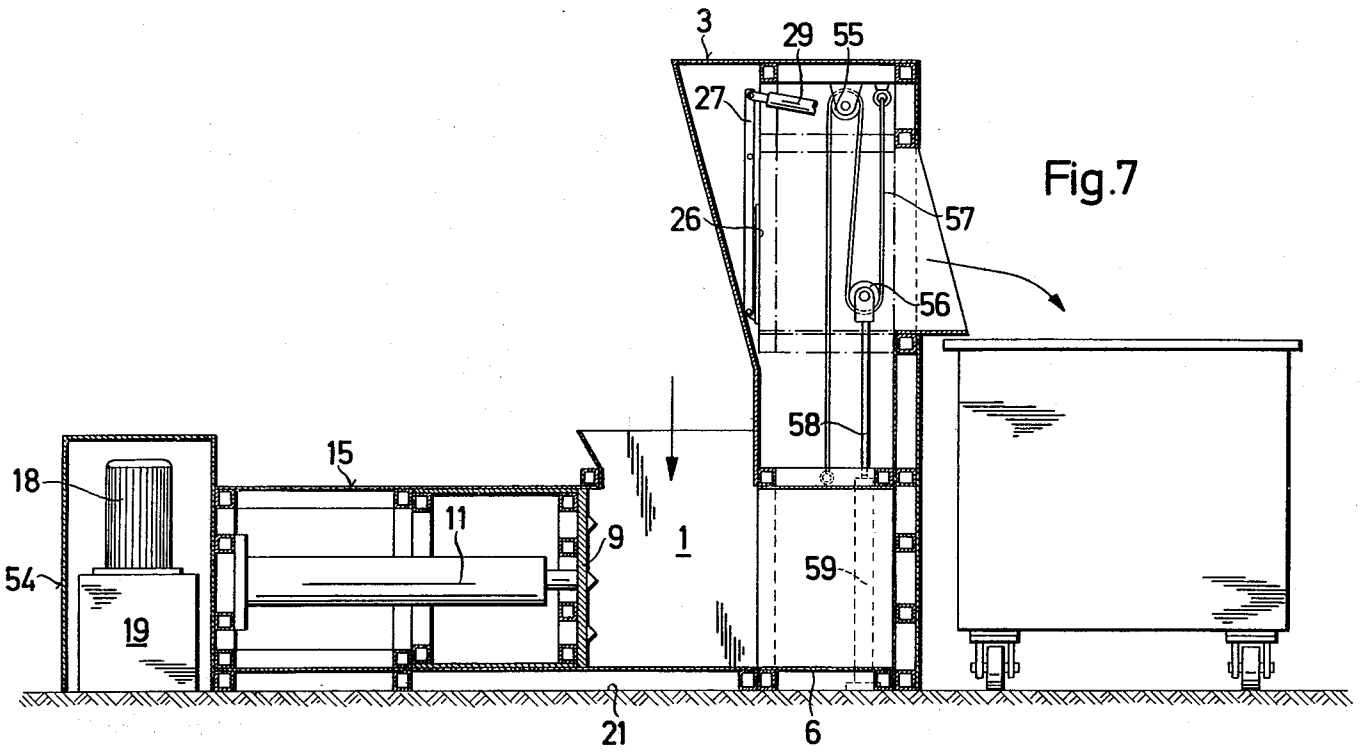

Further details and features of the invention will be found in the following specification and in the patent claims. The drawing shows in FIG. 1 a vertical section through a first form of construction;

FIG. 2 a vertical section through a second form of construction;

FIG. 3 a section through III—III of FIG. 2;

FIG. 4 a toggle lever link as the operating mechanism for the ejection plate;

FIG. 5 a scissor linkage as the operating mechanism for the ejection plate;

FIG. 6 a vertical section through a third form of construction;

FIG. 7 a vertical section through a fourth form of construction.

The device according to FIG. 1 comprises a bulk container 1 with an upper charging opening 2. An attachment 3 is fitted to the bulk container 1 adjoining the charging opening 2, of which the side wall 4 opposite the charging opening 2 contains the discharge opening 5. Inside the bulk container 1, the cage 6, which can be raised in front of the discharge opening 5, forms, together with the fixed wall 8 of the bulk container, the compressing space 7. The loose refuse thrown into the bulk container 1 through the charging opening 2 is compressed by the pressure plate 9 into the inside of the cage 6. Angle irons 10 welded on to the front of the pressure plate 9 help to pulverise the refuse. The pressure plate 9 is operated by the hydraulic cylinder 11, the ramming head 12 of which can be extended with the pressure plate 9 into the interior of the cage 6 nearly up to the inner side of the fixed wall 8. The back of the pressure plate 9 is strengthened by a frame of hollow profile bars 13. At the side adjoining the charging opening 2, a slide bar 14 is fixed to the back of the pressure plate 9, which closes the charging opening 2 when the pressure plate 9 is extended. The hydraulic cylinder 11 is accommodated inside a housing 15 and, at its end opposite the pressure plate 9, supported on the housing wall 17 is strengthened by the hollow section bars 16. An electromotor 18 and a hydraulic system 19, for the storage and distribution of the hydraulic fluid supplying the hydraulic cylinder fitted to the device, are located inside the housing 15. To keep the drawing simple, the pipelines carrying the hydraulic fluid to the individual hydraulic cylinders are omitted. The bottom 20 of the bulk container 1 is situated at a distance A above the floor 21 carrying the device. As a result of having the bulk container 1 at a higher level than that of the floor 21, the lift height of cage 6 is reduced and, with it, the overall height of the device, if the two hydraulic cylinders 22 lifting the cage 6 and situated respectively at opposite external sides of the cage are supported on the floor 23 of the device. The cage 6 is supported on a frame 24 of hollow sections in such a way that the inner surface of its floor 25 lies in the same plane as the inner surface of the floor 20 of the bulk container 1. In its maximum raised position, the cage 6, which can be raised by means of the hydraulic cylinders 22, is shown at 6′ in the interior of the attachment 3 by means of a broken line. The ejection plate 26 and the mechanism operating it are located inside the attachment 3. In accordance with FIG. 1, the ejection plate 26 is connected to the free end of a rocking lever 27, the other end of which, situated beyond the fixed fulcrum 28, can be operated by means of a hydraulic cylinder pivoted thereon. If the ramming head 30 of the hydraulic cylinder 29 is extended, the ejection plate 26 moves along the rocking lever 27 into the cage, and forces the pile of compressed refuse contained in the cage through the ejection opening 5, the outside of which is fitted with a sheet metal collar 31, outwards, where it drops into the container 32.

The pressure plate 9 can be operated automatically or manually, for example, when a given height of loose refuse is reached in the bulk container 1. The pressure plate 9 then makes one or more strokes to compress the refuse in the pressing space 7, that is to say, inside the cage 6. Termination of the strokes can, for example, be controlled by the attainment of a given counter-pressure.

The device according to FIG. 2 is to a large extent similar in its design to that shown in FIG. 1. It differs from FIG. 1 in that it has additionally a refuse chute 33 which fits tightly on to the top of the charging opening 2. The right hand side wall of the refuse chute, in the area above the charging opening 2, is formed by the housing wall 34 of the attachment 3. The operating mechanism for the ejection plate 26 comprises a toggle lever linkage 35, which is shown in more detail in FIGS. 3 and 4.

As can be seen from FIGS. 3 and 4, the ends of the elbow lever parts 36*a*, 36*b* are guided by the slide rings 37*a*, 37*b* on the transverse shaft 38. At their ends, the elbow lever parts 36*a*, 36*b* are flexibly pivoted by means of pins, the outer ends being pivoted on the slide rings while the inner ends are flexibly connected to one another around the pin 39. The drive is by the hydraulic cylinder 40 which, when retracted, brings the slide rings closer to one another and, when extended, moves the slide rings apart. FIG. 4 shows the elbow lever mechanism in the retracted position of the ejection plate 26. In this position, the hydraulic cylinder 40 is at maximum extension; the slide rings 37*a*, 37*b* are near the ends of the transverse shaft 38. The guide link 41 is responsible for symmetrical movement of the slide rings when the hydraulic cylinder is retracted. The discharge position of the ejection plate and of the elbow lever linkage is indicated in FIG. 4 by chain lines.

The lower part of FIG. 3 shows the cage in section. The hydraulic cylinders 22 located at the sides of the cage, the lower ends of which are supported on the floor 23, press with their plungers 42 against brackets 43 projecting sideways from the cage 6. When the plungers 42 are extended, the cage 6 is raised on the brackets 43 until the cage 6 has reached the level of the ejection plate 26 or of the discharge opening 5.

In FIG. 5, a scissor linkage is shown as an alternative to the elbow lever linkage in FIG. 4. The scissor parts 44, 45, to which the ejection plate 26 is pivoted at their ends facing the cage 6, are operated by the hydraulic cylinder 46, which is flexibly supported on the scissor component 45. The end of the scissor component 45 which is not connected to the ejection plate 26 is secured to the frame section 48 at 47. The end of the other scissor component 44 which is not connected to the ejection plate 26 is pivoted to the sliding piece 49. The sliding piece 49 moves along the guide bar 50. To extend the ejection plate 26, the hydraulic cylinder 46 is projected; the force exerted on the scissor component 45 is transmitted via the fulcrum 51 common to both scissor components to the other scissor component 44, causing its end to move with the sliding piece 49 along the guide bar 50 in the direction of the arrow G. The end position of the sliding piece 49 is shown at 49'. In this end position, the scissor components 44', 45' are extended so far that the ejection plate 26' reaches the opposing opening of the cage 6. The arrangement of a hydraulic cylinder in conjunction with the elbow joint linkage described in FIG. 4 can, of course, also be employed in place of the hydraulic cylinder 46.

The device already shown in detail in FIG. 1 is depicted in FIG. 6 tilted in a clockwise direction on the frame 24. In this case, the direction of movement of the hydraulic piston operating the pressure plate 9 is not horizontal but obliquely downwards; as in FIG. 1, the direction of movement of the hydraulic cylinders which raise the cage 6 is at right angles to the direction of movement of the pressure plate 9. The arrangement shown in FIG. 6 has the advantage that the left-hand wall 52 of the attachment 3 is vertical, and in consequence a vertical refuse chute (not shown) can be fitted without difficulty to the charging opening 2. The motor 18 and the hydraulic system 19 can be housed inside the housing section 15 underneath the hydraulic piston 11. As already shown in FIG. 1, the ejection plate 26 is retained in its swung-up position by a spring 53 secured to the rocking lever 27.

FIG. 7 shows a simplified form of construction of the refuse compressing device. In this form of construction, both the bulk container 1 and the housing section 15 are supported directly on the floor 21. The motor and pump unit 18, 19 is accommodated in a separate compartment 54 adjacent to the housing section 15. In order to reduce the overall height of the equipment, because of the increased length of movement of the cage 6 in this form of construction, the lifting system for the cage is a cable 57 passing over an upper fixed pulley 55 and a lower moveable pulley 56, the lower pulley 56 being connected to the plunger 58 of the hydraulic cylinder 59 and is thus adjustable for height according to the stroke of the hydraulic cylinder 58. Use of the block and tackle 55, 56, 57 described results in a reduction in the overall height of the attachment 3 to the device, as compared with the use of hydraulic cylinders for raising the cage 6. The ejection plate 26 is, in turn, capable of being operated by a rocking lever 27 via a hydraulic cylinder 29.

I claim:

1. Apparatus for compressing refuse and discharging the compressed refuse downwardly into a separate container comprising the combination of: a refuse receiving chamber, a pressure plate adapted to reciprocate within said chamber between two closed ends thereof, a movable four walled cage which rests in one position adjacent one of said closed ends and being adapted to hold refuse compressed therein between said plate and said one closed end, a refuse feeding opening in one sidewall of said chamber and being positioned so that refuse moves therethrough into said chamber at one side of said cage, a discharge housing mounted above and in communication with said chamber and being adapted to receive said cage in a second position thereof, one sidewall of said housing being directly above said one end of said chamber and having a discharge opening therein, means adjacent an opposite sidewall of said housing to eject compacted refuse from said cage through said opening so it may pass into said separate container and means to raise and lower said cage, said cage forming with said pressure plate and said one end wall a compression space closed on all sides.

2. Apparatus according to claim 1 including means moving said pressure plate in said cage horizontally in a compression stage and said ejecting means including an ejection plate moving obliquely downwards in said cage in a discharge stage at a higher cage elevation.

3. Apparatus according to claim 1 where in said means for raising and lowering said cage comprises a cable and pulleys.

4. Apparatus according to claim 1 including means closing the refuse feeding opening during compression movement of said pressure plate said closing means comprising a slide bar connected operably to said pressure plate.

5. Apparatus according to claim 1 in which said cage comprises a top wall, a bottom wall, two side walls and is open on two sides.

* * * * *